US006666672B1

(12) United States Patent
Steffens

(10) Patent No.: US 6,666,672 B1
(45) Date of Patent: Dec. 23, 2003

(54) DRIVE MECHANISM FOR A SCREW PUMP

(76) Inventor: Ralf Steffens, Wolfischbuhl 37/4, Steinen (DE), D-79585

( * ) Notice: Subject to any disclaimer, the term of this patent is extended or adjusted under 35 U.S.C. 154(b) by 0 days.

(21) Appl. No.: 10/181,998

(22) PCT Filed: Jan. 12, 2001

(86) PCT No.: PCT/EP01/00320

§ 371 (c)(1),
(2), (4) Date: Jul. 23, 2002

(87) PCT Pub. No.: WO01/57401

PCT Pub. Date: Aug. 9, 2001

(30) Foreign Application Priority Data

Feb. 2, 2000 (DE) ..... 100 04 373

(51) Int. Cl.[7] ..... F04C 18/16; F16H 1/22

(52) U.S. Cl. ..... 418/201.1; 74/413; 74/665 G; 74/665 GB

(58) Field of Search ..... 418/201.1, 206.2; 74/413, 414, 665 G, 665 GA, 665 GB

(56) References Cited

U.S. PATENT DOCUMENTS

| | | | | |
|---|---|---|---|---|
| 1,386,792 A | | 8/1921 | Needham | 418/206.8 |
| 1,943,515 A | | 1/1934 | Davis | 222/241 |
| 2,937,807 A | | 5/1960 | Lorenz | 417/247 |
| 3,779,675 A | * | 12/1973 | Magdhuber et al. | 74/665 GA |

FOREIGN PATENT DOCUMENTS

| | | | | |
|---|---|---|---|---|
| DE | 19522551 C2 | | 5/2000 | |
| JP | 2-153285 | * | 6/1990 | 418/201.1 |
| JP | 6-317168 | * | 11/1994 | 418/201.1 |

* cited by examiner

*Primary Examiner*—John J. Vrablik
(74) *Attorney, Agent, or Firm*—Volpe and Koenig, P.C.

(57) ABSTRACT

The invention concerns a screw pump (10) that is configured as a dual-shaft positive displacement motor and that comprises two positive displacement spindle rotors (1 and 2) rotating in opposite directions and having external toothing. In order to provide a quiet and simple drive mechanism for said rotors (1 and 2) while ensuring synchronization and increased rotational speed, contrate gear-like gearwheels (3 and 4) are mounted on both rotors (1 and 2) rotating in opposite directions or the rotor spindles in a corresponding plane, in which a larger contrate gear-like driving toothed wheel (5) engages in such a way that both spindle rotors (1 and 2) are driven in opposite directions at an increased rotational speed, wherein said contrate gear similarity also includes a crown gear with internal and external toothing working in connection with front toothed wheels or bevel gears and the possibility that only the driving toothed wheel (5) or only the driven gearwheels (3 and 4) are contrate gear-like.

6 Claims, 8 Drawing Sheets

DRIVE MECHANISM FOR A SCREW PUMP

Figure 1:
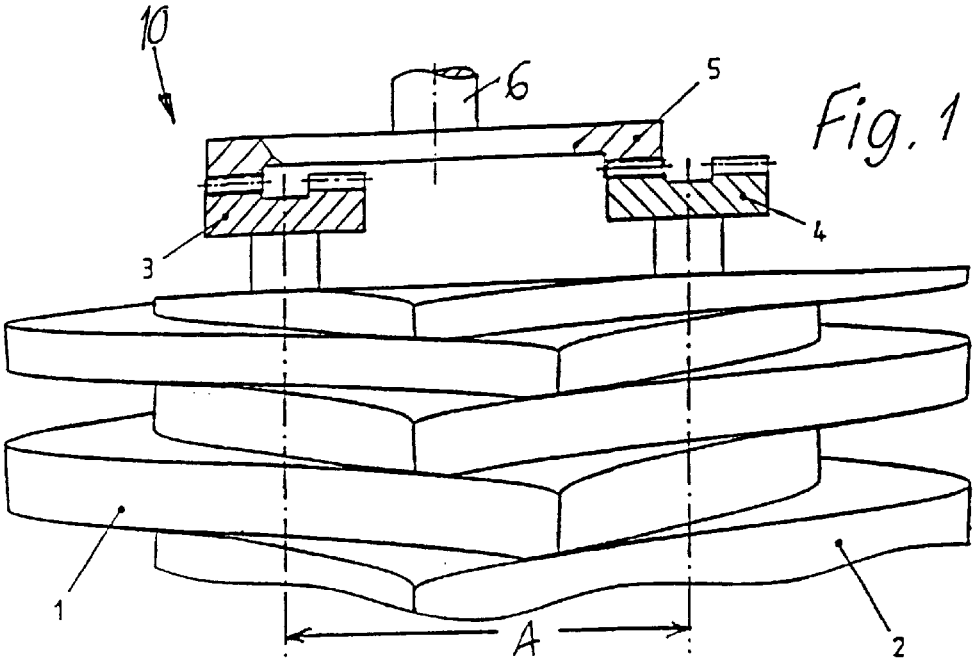

The present invention relates to a dry-sealing screw pump with two positive displacement spindle rotors that have external teeth and rotate in opposite directions, and which are used to deliver and compress gases, a gear wheel that is used to drive and synchronize the rotors being arranged on each of said rotors.

Dry-sealing pumps are becoming increasingly important, in particular in the domain of vacuum technology, for known wet-running vacuum systems such as the liquid rotary machines and rotary disc pumps, are being replaced ever more frequently by dry sealing pumps because of more stringent demands imposed by environmental-protection regulations and ever increasing operating and disposal costs, and because of increased demands for the purity of the delivery medium. These dry-sealing machines include screw pumps, claw pumps, diaphragm pumps, piston pumps, and scrolling machines, as well as Roots vacuum boosters. Common to all of these machines is the fact that they cannot satisfy today's requirements with respect to reliability and robust construction, or with respect to installed size and weight combined with a low price.

Dry-sealing screw pumps are being used to an ever increasing extent in vacuum technology because, as typical twin-shaft displacement machines, they can realize the high compression capability that is specific to vacuum technology and do this very simply in that they achieve the required multi-stage configuration as a series of closed working chambers by way of the number of loops per spindle rotor. In addition, the non-contact (rotation) of the spindle rotors permits an increased speed of rotation for the rotors so that there is a simultaneous increase in both nominal throughput and charging efficiency relative to the installed size.

In the case of modern spindle vacuum pumps, which is to say in the case of screw pumps, the desired speeds of rotation for the spindle is in most instances clearly above the nominal speed of rotation of the asynchronous motors that are usually used for the drive systems because of their robust construction, so that a frequency converter or an up-stream gear drive has to be used in order to increase the speed of rotation. At these increased rotor speeds which, in most instances are clearly above 3000 r.p.m. (order of magnitude approximately 10,000 r.p.m.) the non-contact rotation of the two displacement spindles within the working chamber of the pump is absolutely essential.

Today, in the majority of cases, this is done with simple gear wheels. When this is done, because of the high speeds of rotation that are desired, this results in very high peripherals speeds for the teeth, with a simultaneously smaller specific flank loading, so that this type of machine is inclined to produce a so-called chatter because of the high dynamic factor.

A dry-sealing screw pump of this kind, with two gear wheels that mesh with each other for mechanical synchronization is described in DE 195 22 551 C2.

In addition to this synchronization tooth construction of the two spindle rotors, these must as a rule be preceded by a spur-gearing stage that is used to increase the rotational speed, so that in such a case a total of four front-toothed gears are needed. Up to now, it has not been possible to combine the two parallel gearing stages in a favorable manner, for direct engagement of a driving pinion in the synchronization toothing of the two spindle rotors that rotate in opposite directions would result in a driving gear wheel that is clearly too large by the factor of the desired increase of the rotational speed, because the working circle of the two synchronization gear wheels which are of equal size must of necessity correspond to the distance between the axes of the rotors used in the screw pump.

For this reason, it is the objective of the present invention to create a screw pump of the type described in the introduction hereto, in which the drive and the synchronization of the two spindle rotors for a fast running screw pump are as simple and as quiet as possible.

In order to achieve these objectives, which are apparently contradictory, the screw pump defined in the introduction hereto is characterised in that the toothing diameter of the two gear wheels for the two displacement spindle rotors hereinafter referred to as the rotors is smaller than the distance between the axes; in that a driving gear wheel engages in the two gear wheels of the rotors; and in that the meshing of the driving gear wheel with the driven gear wheels is realized in the form of a contrate like gear wheel. For the purposes of the specification, the term contrate like gear is used, and it should be understood that the this term includes the following types of gears: a spur gear with teeth parallel to the gears axis of rotation, a crown gear with teeth perpendicular to its axis of rotation, a spur/crown sear having both parallel and perpendicular teeth, and finally, a bevel gear having teeth at an angle to the gear's axis of rotation as illustrated. When the generic term contrate like gear is not used, the appropriate more specific term, spur, crown, spur/crown, and bevel is used.

By employing this solution according to the present invention, the peripheral speed of the gear wheels for the rotors can be appreciably reduced and the specific flank loading on the teeth can be increased, so that the level of noise and the dynamic factor are both reduced. In addition, the desired increase in the rotational speed from the driving gear wheel to the spindle rotors can be achieved very simply by way of the diameter ratios and gear wheel tooth ratios of this driving gear wheel to the gear wheels of the rotors.

In addition, for all practical purposes, only three gear wheels are required and these are simple to install, which improves the cost situation. Furthermore, the "concept of the complete spindle unit" can be implemented very simply:

Because the cost of the high rotor speeds, good balancing of the overall rotating rotor unit is expedient, which is to say that it is not sufficient to balance only the displacement rotor, for in the end, because of the subsequent addition of the extra elements such as rotor bearings, shaft seals, and gear wheels, even though each individual part is in itself well balanced the overall balance of these rotating units will be changed in such a way that the desired balanced mass of the total rotating unit can no longer be guaranteed. However, retrobalancing of a screw pump is costly. In the case of conventional synchronization teeth that engage in each other, the concept of the complete spindle unit can only be replaced by the double engagement of spindle delivery threads and synchronization gear wheels at great cost, because the intermediate bearing and expansion chamber shaft seals have to be set up and installed so as to be free of leaks.

Because of the solution according to the present invention, whereby the direct engagement of the gear wheels that are attached to the rotor with each other is avoided, assembly of the previously balanced unit is now made simpler so that the result achieved by the previous balancing is retained after installation.

Additionally, the solution according to the present invention makes it possible that the motor axis can be arranged in the same direction as the two spindle. rotor axes or at right angles thereto. This also reduces the amount of space required for the overall screw pump together with its motor, and facilitates the way in which the motor is cooled by the air flow, and can be adapted to any particular design features.

It is particularly useful if the driving gear wheel is greater than the two gear wheels that are fixed to the two spindle rotors. This is made possible mainly by the measure according to the present invention whereby the diameter of the toothing of the two gear wheels for the rotors is smaller than the distance between the axes of the two rotors, so that the driving gear wheel engages in both these gear wheels and can be of a corresponding size. This also makes it possible to realize the drive and synchronization for the two spindle rotors for a fast running screw pump in the simplest possible way and, at the same time, raise the speed of the two rotors by the desired factor, which can, for example, be between 1.5 and 4. Because they are of the diameter that is smaller than the distance between the axes, the two displacement spindle pump rotors can be acted upon together by a driving gear wheel with a tooth count that is greater by the factor of the desired rotational speed increase, so that the two spindle rotors can be driven in opposite directions at increased speed and be synchronized with each other at the same time. Because of this, the screw pump can be driven at a higher speed, whereby the compression power, charging efficiency, and thus the volumetric efficiency all are increased. At the same time, a more than proportionally higher pumping capacity is achieved from the identical machine size, so that specific costs-relative to volumetric flow-are reduced accordingly. The factor for increasing the speed can be the value of 1.5 to 4, as discussed heretofore, or if necessary be outside these limits relative to the standard rotational speed in the case of a direct drive. In an advantageous manner, it is possible to avoid the use of frequency converters-which are, generally speaking, costly-in order achieve the speed increase that is known per se.

The driving gear wheel can be mounted directly on the shaft of a drive motor. This also helps to make the overall drive system simpler.

In order to lubricate the point of engagement between the gear wheels, a lubricant can be fed internally onto the driving gear wheel. Because of the present invention's arrangement and association of the gear wheels, lubrication can be greatly improved if lubricant is applied to the inside diameter of the toothed side of the driving gear wheel, in particular a contrate like gear wheel, when centrifugal force will distribute the lubricant to the point where the tooth flanks engage with each other; this will also help to reduce the level of noise that is generated.

The driving gear wheel and/or the gear wheel that is attached rigidly to the spindle rotor can be in the form of a contrate like gear wheel. According to the solution according to the present invention, the contrate like gear toothing or the configuration of the gear wheel(s) has already been designated. This can thus refer either to the driving gear wheel or to the gear wheels that are attached rigidly to the spindle rotor, or to all of the gear wheels. This means that the common engagement of the driving gear wheel with the two gear wheels on the rotors can be configured so as to save as much space as possible.

One useful configuration can be such that the driving gear wheel has one or two rings of teeth that are arranged like crown or crown/spur gears, and that these engage with the gear wheels that are attached rigidly to the rotor and configured as spur wheels. This means that there are relatively simple gear wheels on the rotors and that the crown or crown/spur gear like wheels of the driving gear wheel can engage in these, in that the toothed rims of the driving gear wheel are introduced into the space between the two driven gear wheels.

Another configuration and embodiment of the present invention can be such that as an internally and externally toothed spur gear, the crown/spur like gear wheel drives by way of its interior toothing a gear wheel on one rotor shaft, which is fixed to the rotor and configured as a spur gear, and by way of its external toothing drives the other gear wheel on the second rotor shaft, which is mounted rigidly on the rotor and configured as a spur gear wheel; it does this such that they rotate synchonously, in opposite directions, and at increased speeds of rotation. The crown/spur gear like driving gear wheel can thus be represented as or understood to be an internally and externally crown gear ring that with its two sets of toothing drives in each instance a classic spur gear in the desired manner and a crown gear in the desired manner as well, and so that they are synchronized in opposite directions and so that they are driven at an increased speed.

In order to save costs and reduce the amount of noise that it generates, a gear ring of this kind can be produced as a bundle of laminations.

Another embodiment of the present invention makes provision such that the teeth of the contrate like gear wheels are in each instance arranged on a cone, and the angle of the cone of the two sets of teeth that are provided on the driving gear wheel is relatively flat or pointed; this is sometimes called a beveled gear. This means that the gear wheels that are attached rigidly to the rotors are not spur gear wheels but rather also bevel gears with a relatively pointed angle of taper; under certain circumstances, this improves the manner in which the sets of teeth engage with each other.

Another possibility is such that the gear wheels that are connected to the rotors of the configured as contrate gear wheels, and the driving gear wheel is configured as a spur gear. This spur gear can then engage simultaneously on the areas of the contrate gear like gear rims that face each other, for example, when the toothing on the driving gear wheel can, however, be interrupted by an annular groove and confined to the area in which the teeth mesh with each other.

Mainly in the embodiments in which the driving gear wheel has two contrate gear like sets of teeth-in a more or less conical arrangement-it is in a more useful manner possible that the axis of rotation of the driving gear wheel be arranged at a right angle to the axis of rotation of the driven gear wheels and rotors; and in that the driving gear wheel that has a gear ring on each of the two sides that face away from each other meshes in the space between the two with driven gear wheels that are arranged in a common plane, and meshes with these gear wheels. This results in the above described space-saving arrangement and, at the same time, in simple production and assembly.

Mainly in a combination of individual or more of the features and measures described above, the result will be a drying-sealing screw pump, the drive for which is restricted to a few gear wheels, which permits mechanical synchronization and at the same time an increase in the rotational speed of the rotors, and does so in a simple manner. In addition, because of the simplification of the overall arrangement, it is possible to achieve good balancing of a rotating parts prior to assembly, so that the desired high rotor speeds can be implemented in a more favorable manner.

Figure 2:
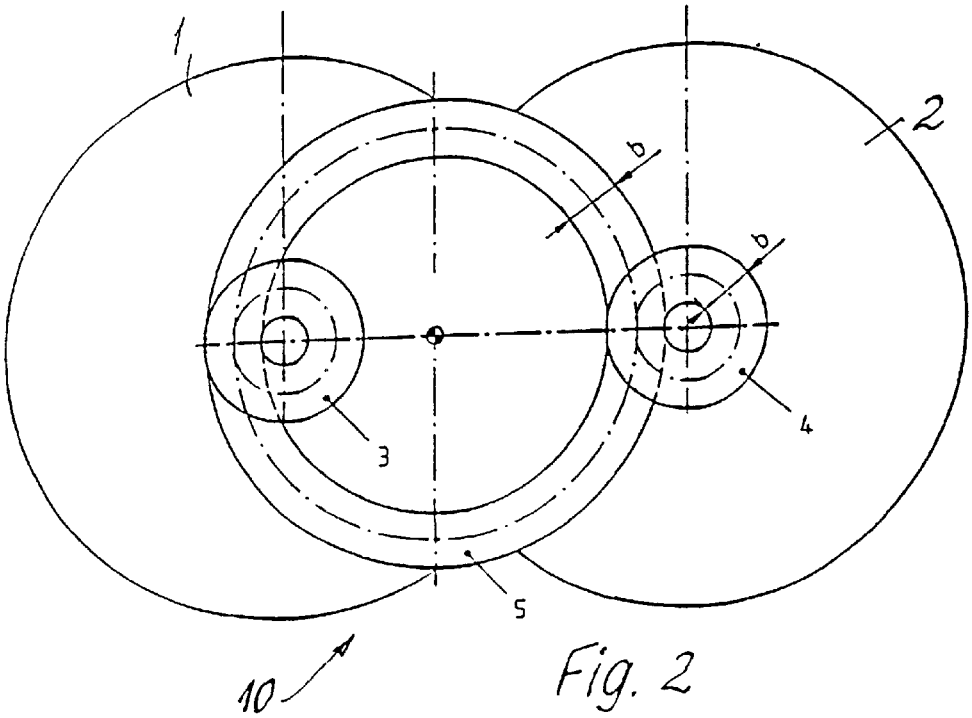
Figure 3:
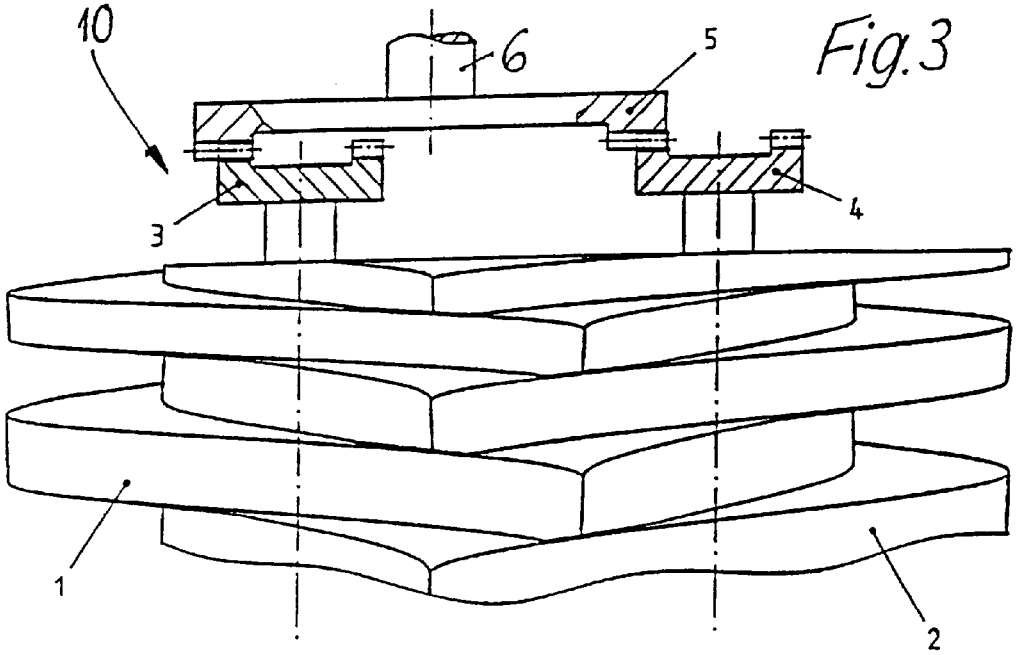
Figure 4:
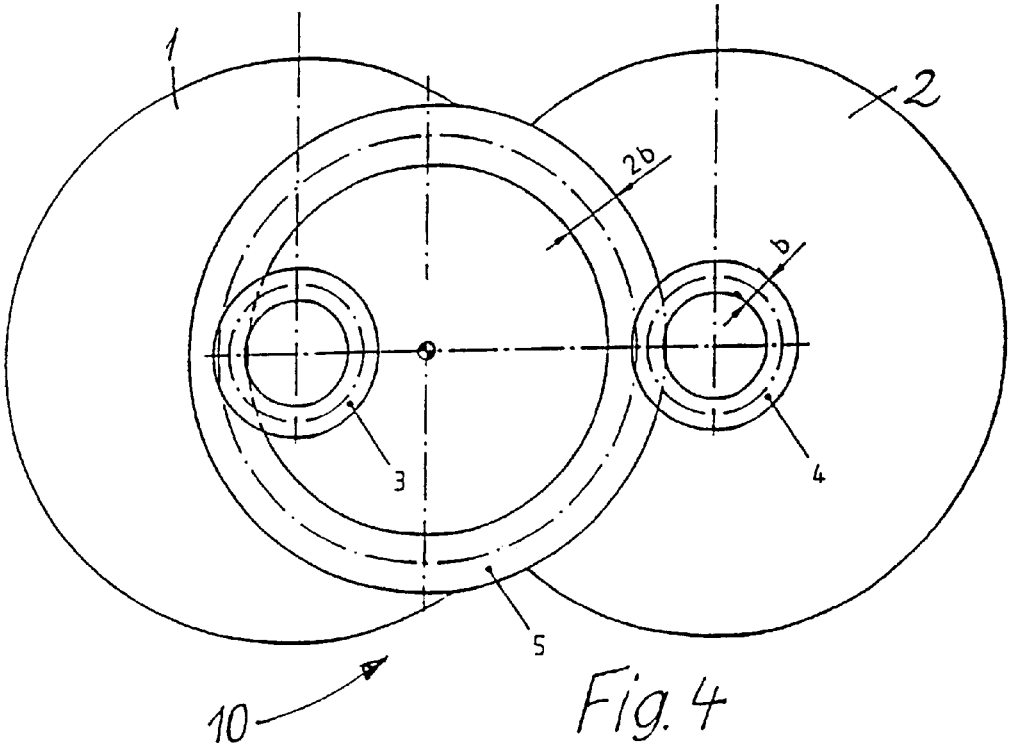
Figure 5:
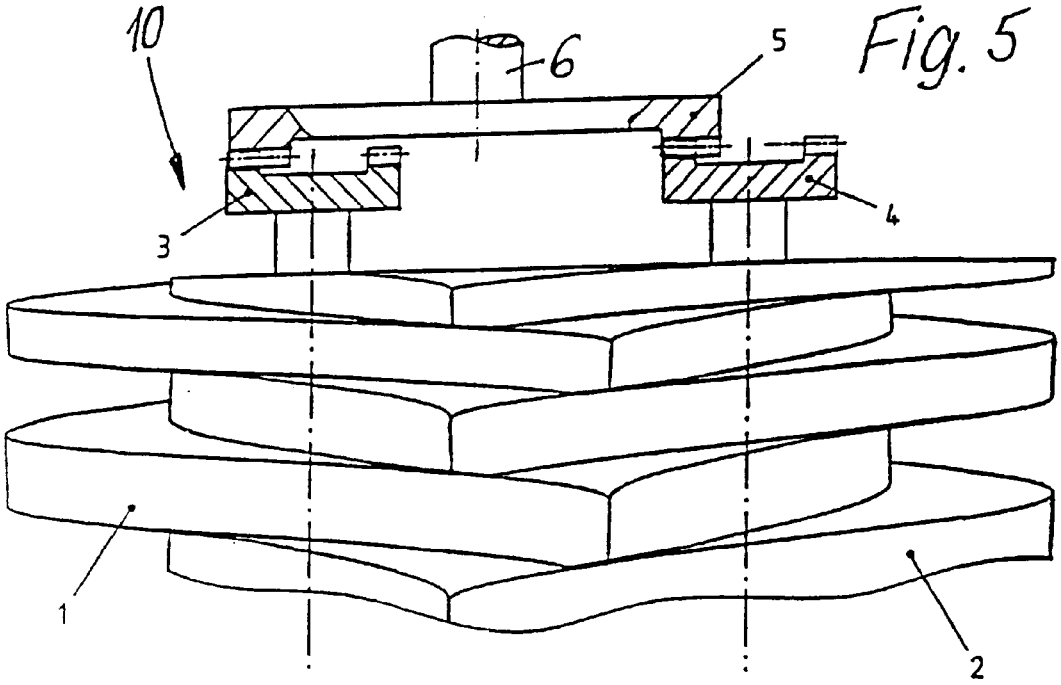
Figure 6:
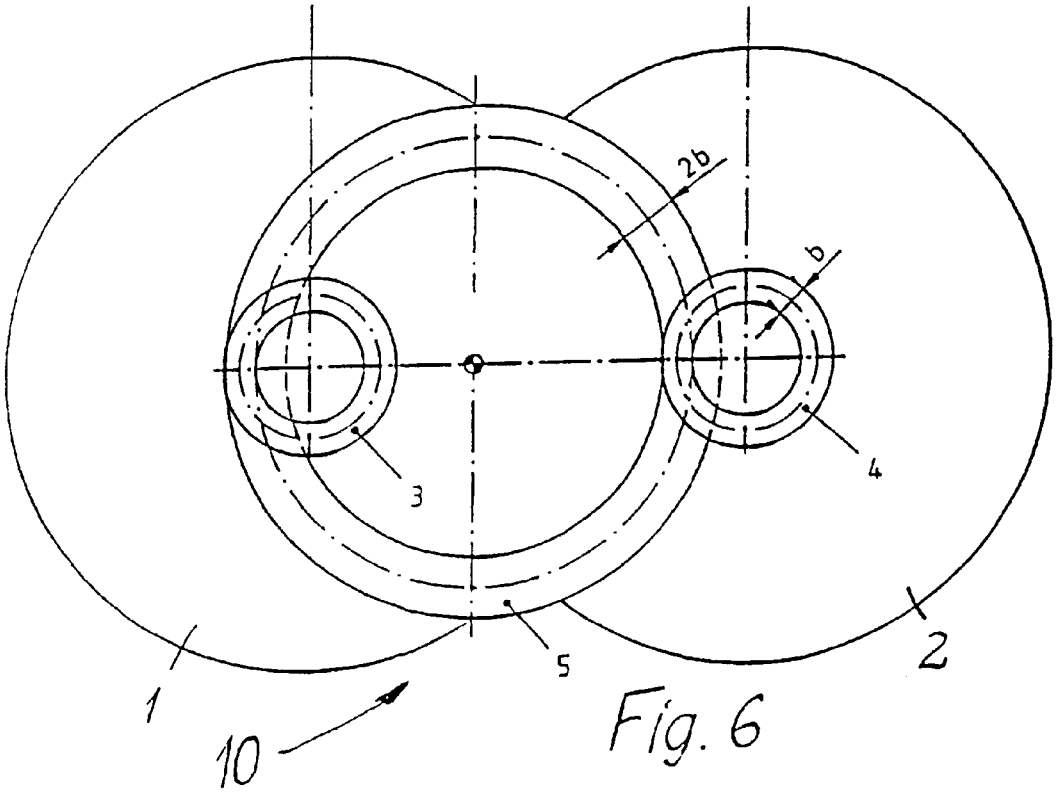
Figure 7:
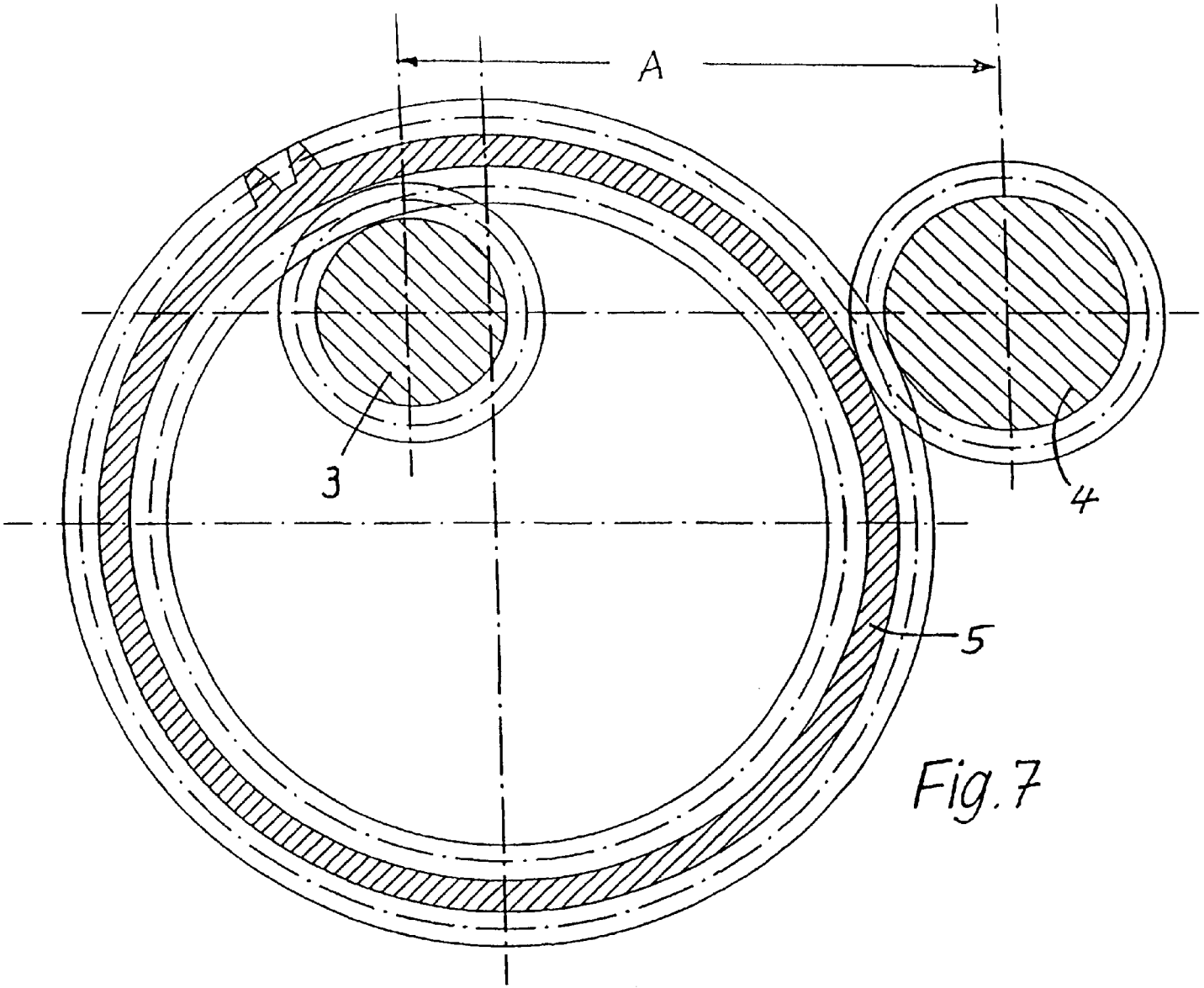
Figure 8:
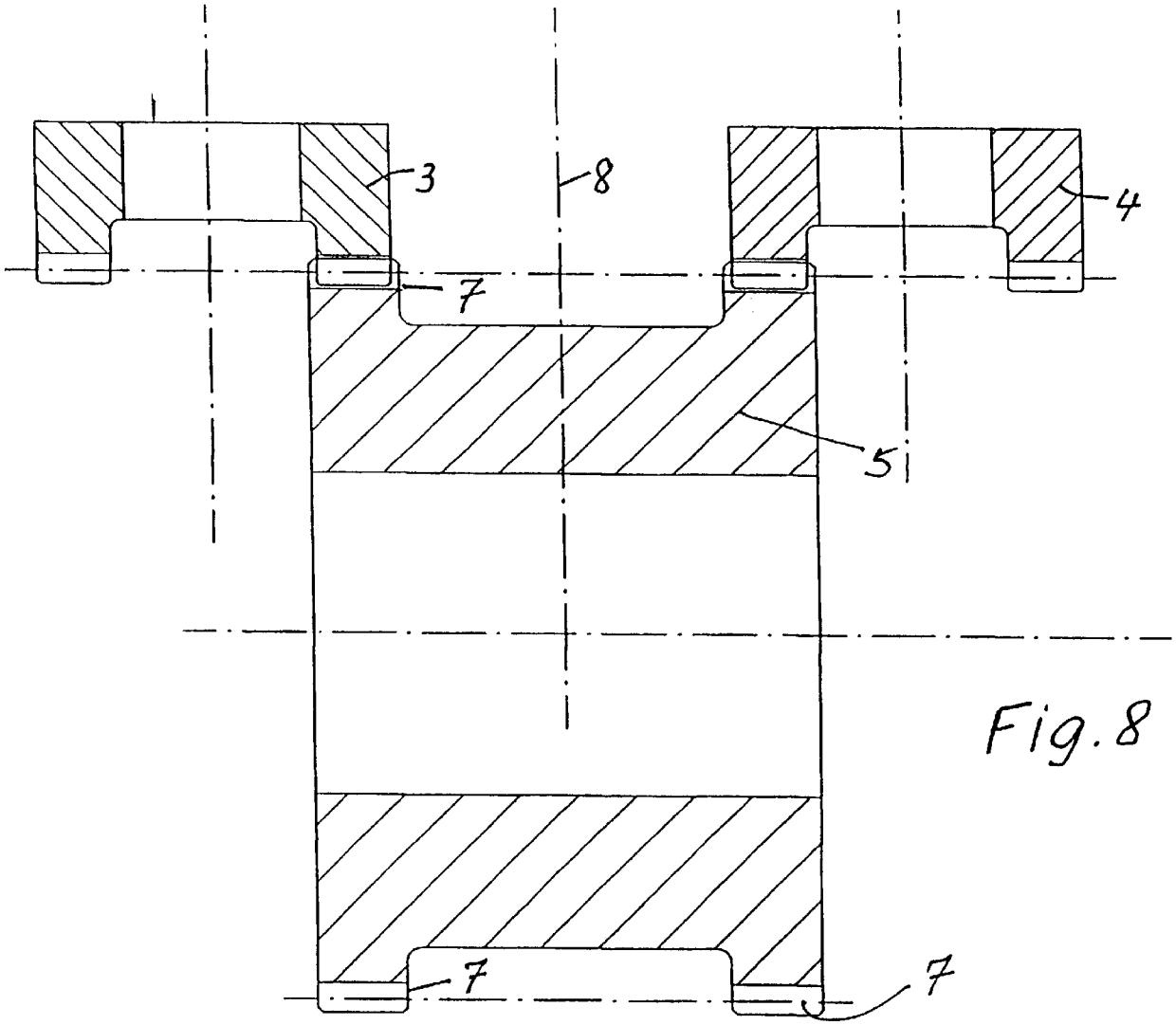
Figure 9:
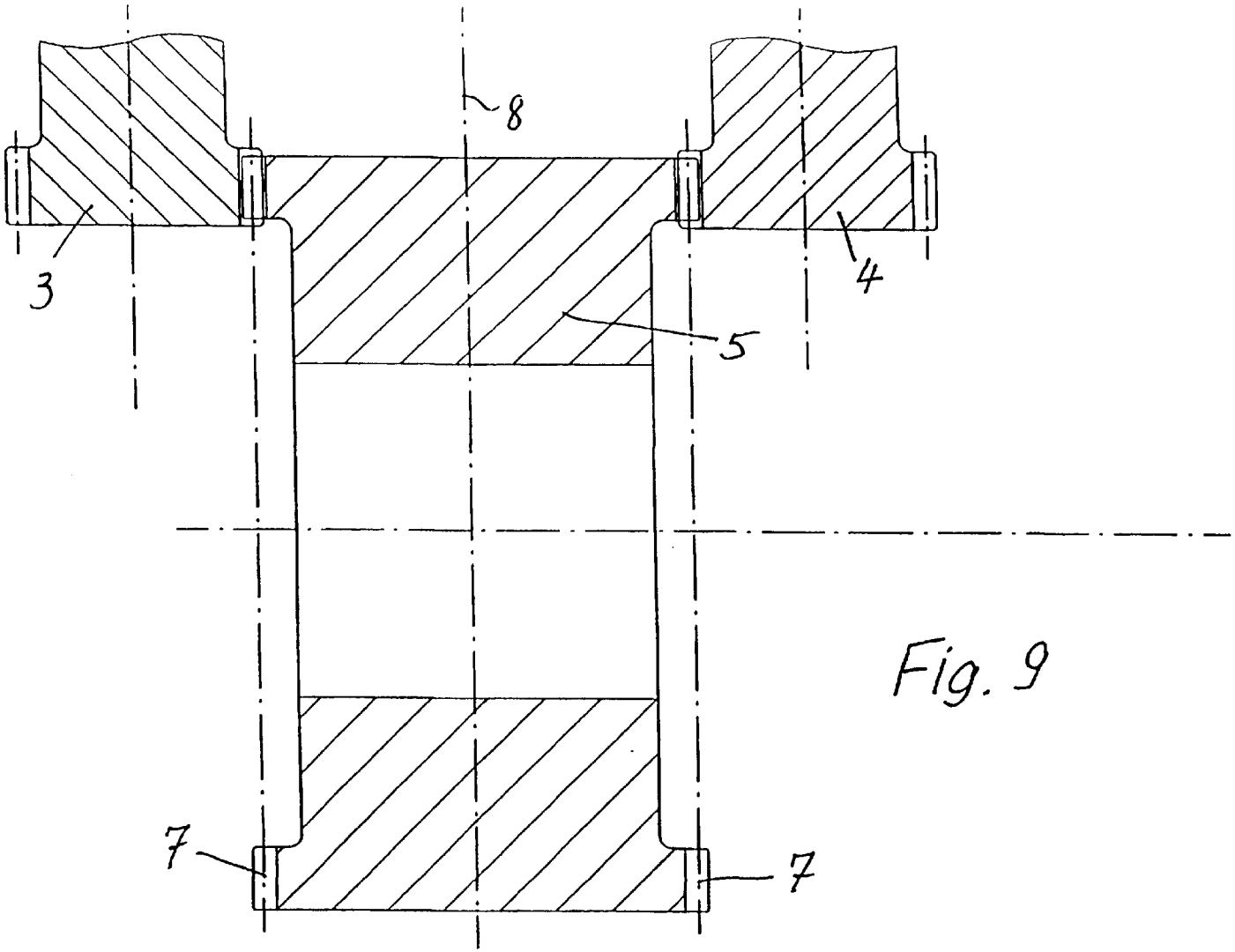
Figure 10:
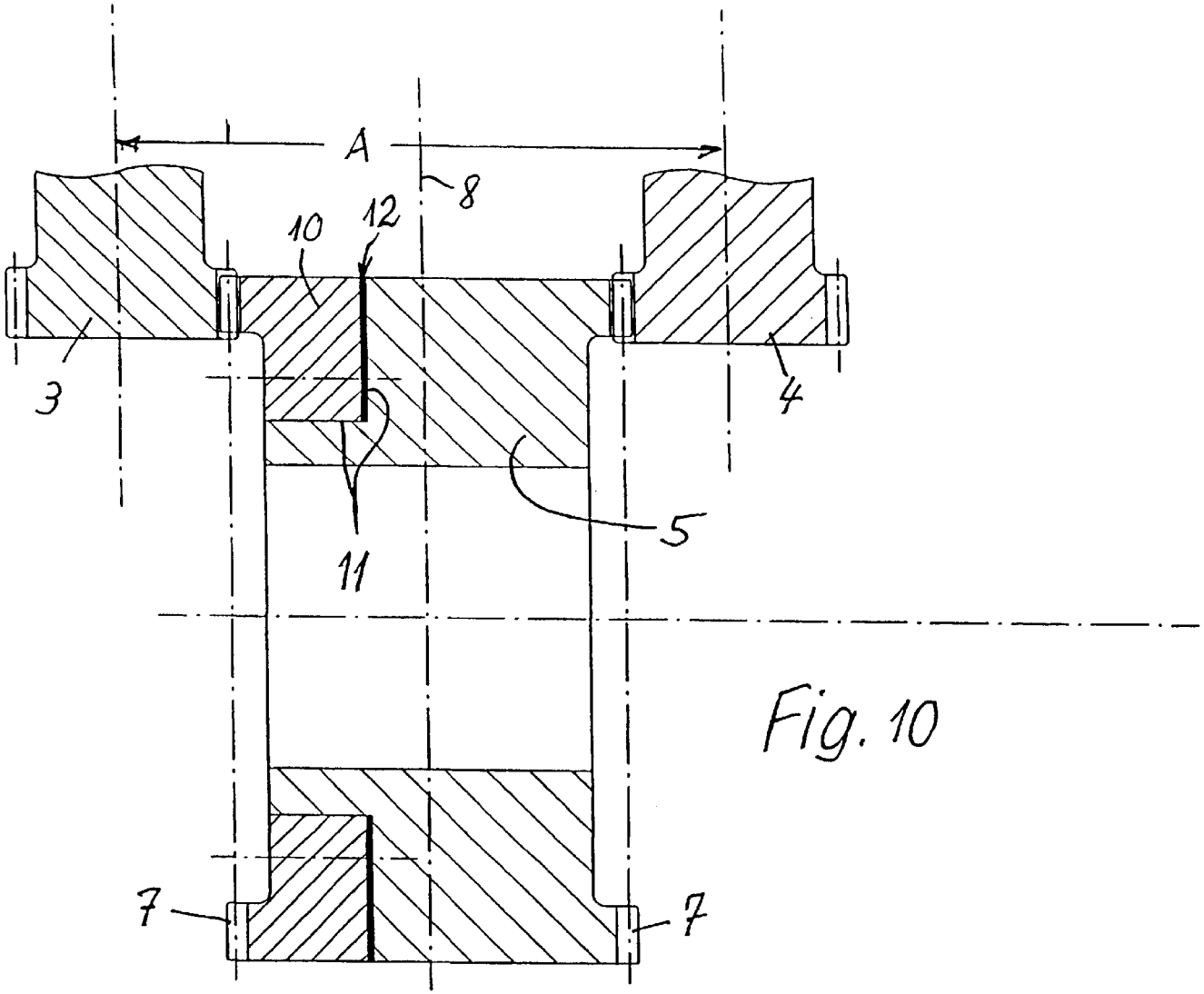
Figure 11:
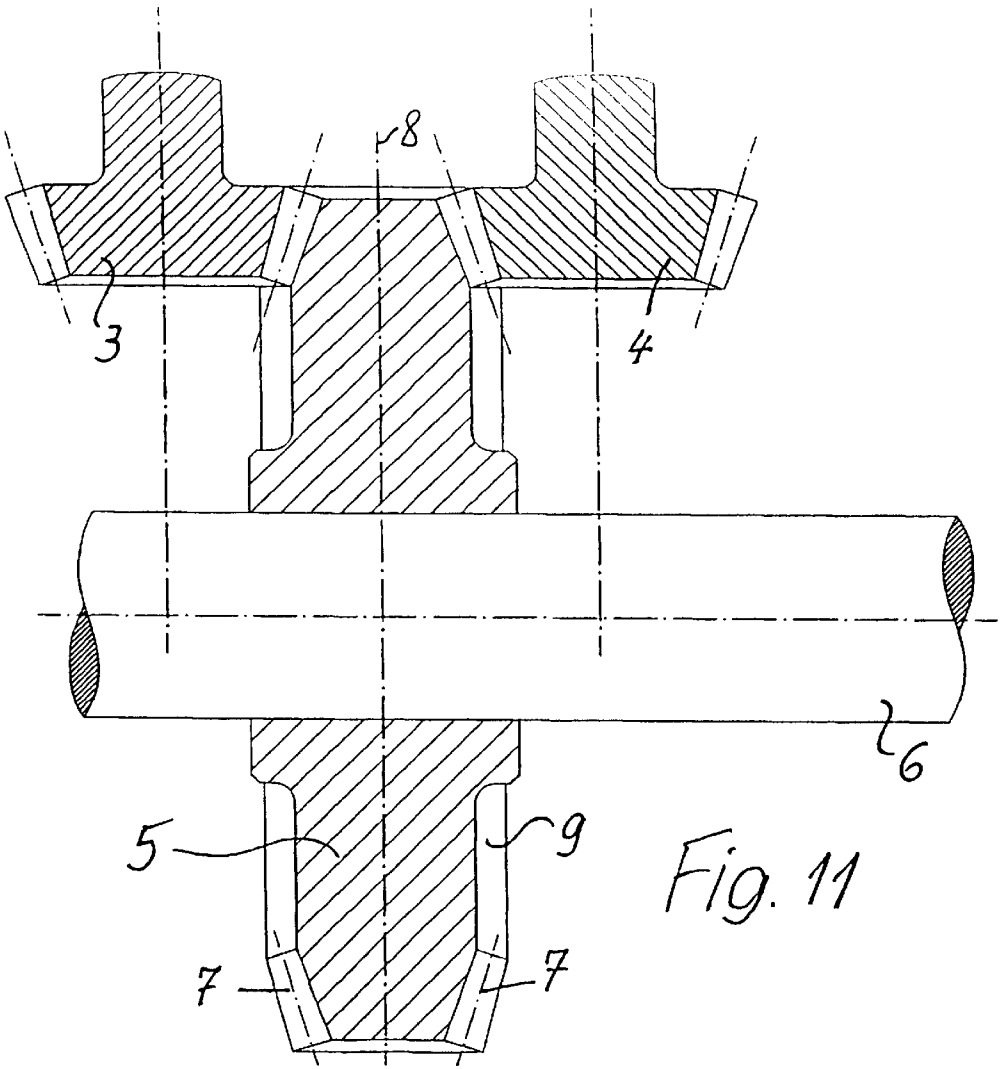

Embodiments of the present invention are described in greater detail below on the basis of the drawings appended hereto. These drawings show the following:

FIG. 1: a partial side view of a dry sealing screw pump according to the present invention, with two externally toothed displacement spindle rotors that rotate in opposite directions and which are shown only in part of their axial extent, the synchronization and desired increase in rotational speed of the two displacement spindle rotors being effected by the crown gear like toothing, with a crown gear wheel on the rotors and a common crown gear wheel that engages with these as the driving gear wheel;

FIG. 2: a plan view of the gear rings of the crown gear like toothing, shown diagrammatically, and the face side of the rotors that is proximate to the driving gear wheels;

FIG. 3: a drawing, corresponding to FIG. 1, of a modified embodiment in which the meshing of the teeth is effected only over a part of the width of the toothing of the driving gear wheel, and the driving gear wheel with its crown gear like gear wheel extends on the outside radially beyond the crown gear like gear wheels on the rotors;

FIG. 4: a drawing corresponding to FIG. 2 of the embodiment shown in FIG. 3;

FIG. 5: a drawing corresponding to FIG. 1 and FIG. 3 showing a modified embodiment in which the gear ring of the crown gear like driving gear wheel is wider than the driven gear wheels that are fixed rigidly to the rotor, and extends radially inwards relative to these gear rings of the driven gear wheels;

FIG. 6: a plan view, corresponding to FIG. 2 and FIG. 4, of the gear rings and face sides of the rotors;

FIG. 7: a cross section of a modified embodiment of the driving and of the driven gear wheels, the crown/spur gear like driving gear wheel being configured as an internally and externally toothed gear ring, its inner toothing acting on a gear wheel that is fixed to the rotor and configured as a spur gear wheel, its outer toothing acting on the other gear wheel that is fixed to the rotor and configured as a spur gear, and driving this;

FIG. 8: A longitudinal cross section through another modified version, in which the gear wheels that are connected to the rotors are crown gears, with which a spur gear meshes with two gear rings that are spaced apart, the axis of rotation of the driving gear wheel being arranged at right angles to the axes of the driven gear wheels;

FIG. 9: a drawing of a modified embodiment corresponding to FIG. 8, in which the driving gear rings are arranged in the manner of crown gears on a common gear wheel so as to face away from each other and engage between the toothing of two gear wheels that are fixed to the rotor and configured as spur gears, and FIG. 10: an advantageous configuration of the present invention, modified relative to FIG. 9, in which the two gear rings of the driving gear wheel are provided on separate parts of the ring and which, when assembled, form the driving gear wheel and permit adjustment in an axial direction and in the direction of rotation, and FIG. 11: a drawing corresponding to FIG. 8 and FIG. 9, in which the beveled gear like toothings are arranged on a truncated cone and the gear wheels and gear rings are configured as bevel gears, and the driving gear wheel meshes with two gear rings that are arranged on opposing sides between the two gear wheels 7 fixed to the rotors, in the toothing thereof, the driving axis of the driving gear wheel being arranged the right angles to the axes of the rotors.

A screw pump that bears the overall reference number 10, which is shown in FIG. 1 to FIG. 6 with reference to the most important parts and shown in FIG. 7 to FIG. 11 with reference to the system of driving toothing, has two externally toothed positive displacement spindle rotors 1 and 2 that rotate in opposite directions and which are used to deliver and compress gases within a housing (not shown herein). On each of the rotors 1 and 2 there is a gear wheel 3 and 4, these being differently configured in the various embodiments,.although they bear the same reference numbers; these gear wheels 3 and 4 are used to drive and synchronize the rotors 1 and 2.

The diameter of the teeth of these two gear wheels 3 and 4 for the two positive displacement spindle rotors 1 and 2, are in each embodiment smaller than the space A between the axes of the two rotors 1 and 2. In addition, in all the embodiments there is a driving gear wheel 5 that engages with two gear wheels 3 and 4, or with-the toothing thereof. This provides a contrate gear like meshing or configuration of the gear wheel(s), which will be described in greater detail below.

FIGS. 1 to 11 clearly show that-regardless of its shape-the driving gear wheel 5 is larger than the two gear wheels 3 and 4 that are fixed rigidly to the spindle rotors so that, on the one side, the two rotors 1 and 2 will be synchronized as a result of the matching number of teeth and size of the driving gear wheels 3 and 4 and, on the other, because of the larger dimensions of the driving gear wheel 5 with its correspondingly greater number of teeth, the speed of rotation of the driven gear wheels 3 and 4 will be increased relative to the speed of rotation of the driving gear wheel 5. The driving gear wheel 5 is best secured directly on the shaft 6 of a drive motor (not shown herein).

In a manner that is not shown herein, a lubricant that is used to lubricate meshing of the teeth can be fed internally onto the driving gear wheel 5 so that for all practical purposes it is moved onto the teeth and the point engagement thereof by centrifugal force.

It has already been stated that the driving gear wheel 5 and the driven gear wheels 3 and 4 mesh with each other in the manner of contrate gears. According to the various embodiments of the present invention, this can be arranged differently or as defined in this description.

In FIGS. 1 to 6, the driving gear wheel 5 and of the driven gear wheels 3 and 4 that are fixed rigidly to the rotors are each configured as crown gears. Thus, the shaft 6 of the drive motor can be arranged so as to be parallel to the rotor axes.

However, the driving gear wheel 5 can have one or, as shown in FIGS. 9 and 10, two crown gear like and parallel gear rings 7 that face towards opposite sides and engage with the gear wheels 3 and 4 that are configured as spur gears and are fixed rigidly to the rotors.

FIGS. 9 and 10 show embodiments that are similar to each other each having two crown gear like gear rings 7 that engage with gear wheels 3 and 4 that are configured as spur gears and are attached rigidly to the rotors. As compared to FIG. 9, FIG. 10 shows the advantageous feature that the two gear rings 7 of the driving gear wheel 5 can be adjusted and secured relative to each other in an axial direction and/or in the direction of rotation. This is achieved in that one gear ring is arranged on a ring 10 that fits on a shoulder 11 of the driving gear wheel 5 and completes this shoulder 11 to form a gear wheel 5 as in FIG. 9; and in that an annular washer 12 can be inserted in an axial direction between the shoulder 11 and the ring 10 so that the distance between the two gear rings 7 can be adjusted in the axial direction, depending on the thickness or the number of annular washers 12. The attachment of the ring 10 and thus also of the annular washer 12 can be effected with the help of screws (not shown herein)

This configuration permits exact angular positioning of the two gear rings 7 of the driving gear wheel 5 relative to the two driven gear wheels 3 and 4, independently of each other. Each set of teeth has a torsional backlash by which one gear wheel can be rotated relative to the other until contact on the one flank of the tooth becomes contact on the non-working flank. This torsional backlash in the teeth is technically unavoidable. It can be adjusted and optimized deliberately by way of the annular disc 12. This means that each set of teeth on the two driven the wheels 3 and 4 has an adjusted and preselected torsional backlash, this possibility also being provided in the embodiment shown in FIG. 11 and, optionally, FIG. 8.

In addition, the gear transmissions ratio between the driving gear wheel 5 and gear wheels 3 and 4 that the fixed rigidly to the rotors can be changed very simply if the gear wheels 3 and 4 can be exchanged or replaced with identical gear rings 7 without the position of the axes of the drive and rotors having to be matched. Only the spacing of the two gear rings 7 on the driving wheel 5 is to be matched by way of the embodiment shown in FIG. 10. The speed of rotation of the rotor for different applications can be changed at very little cost by changing the simple spur gears 3 and 4 while simultaneously matching the space between the gear rings 7.

In order to better equalize the torsional backlash in the teeth, the annular disc 12 can also be flexible.

As is shown in FIG. 7, the crown or crown/spur gear like driving gear wheel 5 can be shown or defined as an internally and externally toothed ring that drives a gear wheel 3 of one rotor shaft or of one rotor 1, which is fixed to the rotor and configured as a spur gear, by way of its internal teeth, and drives the other gear wheel 4 that is similarly configured as a spur gear and attached rigidly to the rotor or the second rotor 2 synchronously in the opposite direction and, because of the different diameters, at an increased speed of rotation. In order to reduce costs and the amount of noise that is generated, the gear ring that forms the driving crown or crown/spur gear like gear wheel can be manufactured as a bundle of laminations.

FIG. 8 shows one embodiment in which, as in the embodiment shown in FIG. 1 to FIG. 6, the gear wheels 3 and 4 that are connected to the rotors 1 are configured as crown gears and the driving gear wheel 5 is configured as a spur gear, the teeth extending not to the whole axial extent of this driving gear wheel 5, but being divided into two gear rings 7 that are spaced apart. As is shown in the embodiment according to FIGS. 9–11, in this case the drive shaft 6 is set at right angles to the axes of the rotors 1 and 2.

FIG. 11 shows one embodiment in which the teeth of the gear wheels 3 and 4 and 5, which in this case are similarly bevel gears, are arranged on a cone, there being two gear rings or sets of teeth that face away from each other on the driving gear wheel 5, as in the embodiment shown in FIG. 9; the angle of the cone of these gear rings or teeth relative to a radial, diametrical plane 8 that is arranged between these two springs or teeth is relatively flat or pointed. The similarity of the two gear rings to bevel gear wheels of the driving gear wheel 5 would be even clearer were the face end hollows 9 that are positioned inward in the radial direction relative to the gear rings were somewhat deeper than is shown in FIG. 10.

Whereas the axis of rotation for the drive shaft 6 of the driving gear wheel 5 is parallel to the axes of the rotors in the embodiment shown in FIGS. 1 to 7, in the embodiment that is shown in FIGS. 8 to 11 it is arranged at right angles to the axes of rotation of the driven gear wheels 3 and 4 and of the rotors 1 and 2, so that the arrangement and association of the drive motor to the rotors can if necessary be predetermined or preselected by selecting the particular form of the contrate gear like gear wheels.

Common to the embodiment shown in FIG. 9 to FIG. 11 is that the driving gear wheel 5 that has a gear ring 7 on each of the sides that face away from each other engages in the space between the two with the driven gear wheels 3 and 4 that are arranged in a common plane, which either permits an increase in the diameter of the driving gear wheel 5 for an identical space requirement, or to a reduction in the overall size of the assembly as a whole.

The embodiments described above are particularly well-suited for use in vacuum technology in particular because-as a result of the relationship of the diameters between the driving gear wheel 5 and the driven gear wheels 3 and 4-this permits an increase in the rotational speed of the rotors 1 and 2 and simultaneous synchronization of the rotary movement, which is particularly useful when generating a vacuum. They are, however, also suited for other applications for screw pumps and compressors of this kind.

The screw pump tend is configured as a dual-shaft positive displacement motor and comprises two externally toothed positive displacement spindle rotors 1 and 2 that rotate in opposite directions. In order to provide a quiet and simple drive mechanism for said rotors 1 and 2 while ensuring simultaneous synchronization and increased rotational speed, contrate gear like gear wheels 3 and 4 are mounted on both rotors 1 and 2 in a corresponding plane in which a larger contrate gear like driving gear wheel 5 engages in such a way that the two spindle rotors 1 and 2 are driven at an increased rotational speed in opposite directions, said contrate gear similarly including a gear ring with internal and external toothing that works in conjunction with spur gears or beveled gear wheels and also includes the possibility that only the driving gear wheel 5 or only the driven gear wheels 3 and 4 are like contrate gears.

What is claimed is:

1. Dry-sealing screw pump (10) with two externally toothed, positive displacement spindle rotors (1, 2) that rotate in opposite directions for delivering and compressing gases, a gear wheel (3, 4) for driving and synchronizing the rotors (1, 2) being arranged on each of the rotors (1, 2), each of the rotors having an axis, characterized in that the diameter of the toothing of the two gear wheels (3, 4) for the two displacement spindle rotors (1, 2) is less than a space (A) between the axes of the two rotors (1, 2); in that a driving gear wheel (5) engages in the two gear wheels (3, 4) of the rotors (1, 2); and in that this engagement of the driving gear wheel (5) with the driven gear wheels (3, 4) is a crown gear type engagement.

2. Screw pump as defined in claim 1, characterized in that the driving gear wheel (5) is larger than the two gear wheels (3, 4) that are mounted rigidly on the spindle rotors.

3. Screw pump as defined in claim 1, characterized in that the driving gear wheel (5) is mounted directly on the shaft (6) of a driving motor.

4. Screw pump as defined in claim 1, characterized in that a lubricant can be delivered internally onto the driving gear wheel (5)in order to lubricate the point of the engagement.

5. Screw pump as defined in claim 1, characterized in that the driving gear wheel (5) and/or the gear wheels (3, 4) that the mounted rigidly on the spindle rotors are configured to be like crown gears.

6. Screw pump as defined in claim 1, characterized in that the gear wheels (3, 4) that the connected to the rotors (1, 2) are configured as crown gear wheels and the driving gear wheel (5) is configured as a front-toothed gear wheel.

* * * * *